US009085428B2

(12) United States Patent
Ikeda

(10) Patent No.: US 9,085,428 B2
(45) Date of Patent: Jul. 21, 2015

(54) MULTI-FEED JUDGING DEVICE, IMAGE FORMING APPARATUS, MULTI-FEED JUDGING METHOD AND MULTI-FEED JUDGING PROGRAM

(71) Applicant: Yuji Ikeda, Kanagawa (JP)

(72) Inventor: Yuji Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/073,992

(22) Filed: Nov. 7, 2013

(65) Prior Publication Data

US 2014/0175740 A1 Jun. 26, 2014

(30) Foreign Application Priority Data

Dec. 25, 2012 (JP) ..... 2012-281306

(51) Int. Cl.
*B65H 7/12* (2006.01)
*B65H 5/06* (2006.01)

(52) U.S. Cl.
CPC ..... *B65H 5/062* (2013.01); *B65H 7/12* (2013.01); *B65H 2404/144* (2013.01); *B65H 2511/13* (2013.01); *B65H 2511/224* (2013.01); *B65H 2557/23* (2013.01); *B65H 2557/2423* (2013.01); *B65H 2557/63* (2013.01)

(58) Field of Classification Search
CPC ..... B65H 7/12; B65H 2511/13; B65H 2511/224; B65H 7/18; B65H 7/20
USPC ..... 271/262, 263, 265.04
See application file for complete search history.

(56) References Cited

U.S. PATENT DOCUMENTS

| | | | | |
|---|---|---|---|---|
| 5,437,445 | A * | 8/1995 | Chang et al. | 271/263 |
| 6,850,717 | B2 * | 2/2005 | Fujikura et al. | 399/45 |
| 2009/0254306 | A1 * | 10/2009 | Ohshima et al. | 702/170 |
| 2011/0210506 | A1 * | 9/2011 | Yamazaki et al. | 271/265.04 |

FOREIGN PATENT DOCUMENTS

| | | | |
|---|---|---|---|
| JP | 62161654 | A * | 7/1987 |
| JP | 10310286 | A * | 11/1998 |
| JP | 3293532 | | 6/2002 |
| JP | 2003012192 | A * | 1/2003 |
| JP | 2008-290810 | | 12/2008 |
| JP | 2009-227404 | | 10/2009 |

* cited by examiner

*Primary Examiner* — Luis A Gonzalez
(74) *Attorney, Agent, or Firm* — Harness, Dickey & Pierce, P.L.C.

(57) ABSTRACT

A multi-feed judging device includes a transporting unit that holds a recording medium between a driving roller and a driven roller, which is driven by the driving roller, and transports the recording medium by rotating the driving roller; a detecting unit that detects a position of the driven roller; a calculating unit that calculates a thickness of the recording medium based on positions of the driven roller when the recording medium is transported and when the recording medium is not transported; a reference value updating unit that updates a reference value of the thickness by using the calculated thickness; a judging unit that judges, using the reference value, whether recording media, which are transported after the reference value was updated, are transported while overlapping each other or not. The calculating unit calculates the thickness when the position is within a predetermined range.

17 Claims, 9 Drawing Sheets

FIG.4A

| | REFERENCE VALUE Y(n) |
|---|---|
| JUDGING MULTI-FEED FOR 2ND SHEET | Y1=X1 |
| JUDGING MULTI-FEED FOR 3RD SHEET | Y2=(Y1+X2)/2 |
| JUDGING MULTI-FEED FOR 4TH SHEET | Y3=(Y2+X3)/2 |
| JUDGING MULTI-FEED FOR 5TH SHEET | Y4=(Y3+X4)/2 |
| · | |
| · | |
| JUDGING MULTI-FEED FOR (n+1)-TH SHEET | Y(n)=(Y(n-1)+X(n))/2 |

FIG.4B

| | REFERENCE VALUE Y(n) |
|---|---|
| JUDGING MULTI-FEED FOR 2ND SHEET | Y1=X1 |
| JUDGING MULTI-FEED FOR 3RD SHEET | Y2=(Y1+X2)/2 |
| JUDGING MULTI-FEED FOR 4TH SHEET | Y3=Y2 |
| JUDGING MULTI-FEED FOR 5TH SHEET | Y4=(Y3+X4)/2 |
| · | |
| · | |
| JUDGING MULTI-FEED FOR (n+1)-TH SHEET | Y(n)=(Y(n-1)+X(n))/2 |

FIG.5

| | REFERENCE VALUE Y(n) |
|---|---|
| JUDGING MULTI-FEED FOR 2ND SHEET | COMPARE X2 WITH X1 |
| JUDGING MULTI-FEED FOR 3RD SHEET | COMPARE X3 WITH Y2 |
| JUDGING MULTI-FEED FOR 4TH SHEET | COMPARE X4 WITH Y3 |
| JUDGING MULTI-FEED FOR 5TH SHEET | COMPARE X5 WITH Y4 |
| · | |
| · | |
| JUDGING MULTI-FEED FOR n-TH SHEET | COMPARE X(n) WITH Y(n-1) |

FIG.7A

Ts=100, Tp=1.7

| | DETECTED THICKNESS X(n) | REFERENCE VALUE FOR COMPARISON Y(n-1) | RATIO X(n)/Y(n-1) | MULTI-FEED JUDGMENT |
|---|---|---|---|---|
| 1ST PAPER | 70 | — | — | — |
| 2ND PAPER | 80 | 70 | 1.14 | NO |
| 3RD PAPER | 110 | 75 | 1.47 | NO |
| 4TH PAPER | 145 | 75 | 1.93 | YES |

FIG.7B

Tp=1.7

| | DETECTED THICKNESS X(n) | REFERENCE VALUE FOR COMPARISON Y(n-1) | RATIO X(n)/Y(n-1) | MULTI-FEED JUDGMENT |
|---|---|---|---|---|
| 1ST PAPER | 70 | — | — | — |
| 2ND PAPER | 80 | 70 | 1.14 | NO |
| 3RD PAPER | 110 | 75 | 1.47 | NO |
| 4TH PAPER | 145 | 92.5 | 1.57 | NO |

MULTI-FEED JUDGING DEVICE, IMAGE FORMING APPARATUS, MULTI-FEED JUDGING METHOD AND MULTI-FEED JUDGING PROGRAM

BACKGROUND OF THE INVENTION

1. Field of the Invention

The disclosures herein generally relate to a multi-feed judging device, an image forming apparatus, a multi-feed judging method, and multi-feed judging program.

2. Description of the Related Art

An image forming apparatus, a copying apparatus, and the like, with a multi-feeding detecting function detects whether recording media are transported while overlapping each other (multi-feed) or not. Such image forming apparatus detects, for example, a thickness of the recording medium and judges whether the recording media are transported while overlapping each other.

Japanese Published Patent Application No. 2009-227404 discloses detecting a position of the driven roller on transporting a recording medium and a position on not transporting the recording medium in a transporting operation by rotating a driving roller. A thickness of the recording medium is detected based on a difference between these positions of the driven roller. According to the thickness of the recording medium, it is judged whether the recording media are transported while overlapping each other.

However, the art disclosed in Japanese Published Patent Application No. 2009-227404 cannot detect precisely the thickness of the recording medium, when a motion of the position of the driven roller includes an error, in the case of continuously transporting plural recording media. Accordingly, the detecting method disclosed in Japanese Published Patent Application No. 2009-227404 has a problem that when the thickness of the recording medium cannot be detected precisely, whether the recording media are transported while overlapping each other cannot be judged.

SUMMARY OF THE INVENTION

It is a general object of at least one embodiment of the present invention to provide a multi-feed judging device, an image forming apparatus, a multi-feed judging method, and a multi-feed judging program that substantially obviates one or more problems caused by the limitations and disadvantages of the related art.

According to one embodiment of the present invention, a multi-feed judging device includes: a transporting unit that holds a recording medium between a driving roller and a driven roller, which is driven by the driving roller, and transports the recording medium by rotating the driving roller; a detecting unit that detects a position of the driven roller; a calculating unit that calculates a thickness of the recording medium based on a position of the driven roller when the recording medium is transported and a position of the driven roller when the recording medium is not transported; a reference value updating unit that updates a reference value of the thickness by using the calculated thickness; a judging unit that judges, using the reference value updated by the reference value updating unit, whether recording media, which are transported after the reference value was updated, are transported while overlapping each other or not. The calculating unit calculates the thickness by using the position detected by the detecting unit, when the position detected by the detecting unit is within a predetermined range.

According to another embodiment of the present invention, a multi-feed judging method includes: a transporting step for holding a recording medium between a driving roller and a driven roller, which is driven by the driving roller, and for transporting the recording medium by rotating the driving roller; a detecting step for detecting a position of the driven roller when the recording medium is transported, and a position of the driven roller when the recording medium is not transported; a calculating step for calculating a thickness of the recording medium based on a position of the driven roller when the recording medium is transported and a position of the driven roller when the recording medium is not transported; a reference value updating step for updating a reference value for the thickness by using the thickness calculated in the calculating step; a judging step for judging, using the reference value updated in the reference value updating step, whether recording media, which are transported after the reference value was updated, are transported while overlapping each other or not. In the calculating step the thickness is calculated by using the position detected in the detecting step, when the position detected in the detecting step is within a predetermined range.

According to the exemplary embodiments, the multi-feed judging apparatus or the multi-feed judging method, in the case of transporting plural recording media, and even when the detected position of the recording medium includes an error, can judge whether the recording media are transported while overlapping each other or not.

BRIEF DESCRIPTION OF THE DRAWINGS

Other objects and further features of embodiments will be apparent from the following detailed description when read in conjunction with the accompanying drawings, in which:

FIGS. 4A and 4B are tables explaining an example of an operation for updating reference values in the multi-feed judging device according to the present exemplary embodiment;

FIG. 5 is a table explaining an example of an operation for judging the multi-feed in the multi-feed judging device according to the present exemplary embodiment;

FIGS. 7A and 7B are tables explaining an example of an operation for judging the multi-feed in the multi-feed judging device according to the present exemplary embodiment;

DESCRIPTION OF THE PREFERRED EMBODIMENTS

In the following, embodiments of the present invention will be described with reference to the accompanying drawings.

A non-limiting exemplary embodiment according to the present application will be described using a multi-feed judging device, which detects a thickness of a recording medium by detecting a position of the recording medium, and judges whether the recording media are transported while overlapping each other based on the thickness. The present invention can be applied to any of a medium feeding device, a medium detecting device, and a transporting detecting device, as well as the multi-feed judging device, which will be explained later. The present invention can be applied also to any apparatus, a device, a unit, a system, or the like, which uses a recording medium, such as an image forming apparatus, a recording apparatus, an image recording apparatus, a combined apparatus, a printer, a scanner, a plotter, or a facsimile apparatus. Moreover, a recording medium detected by the multi-feed judging device according to the present exemplary embodiment includes a medium such as a sheet of paper, a thin or thick paper, a recording paper, an OHP (over head projector) sheet, a synthetic resin film, or a metallic thin film.

Moreover, in the following explanations, recording media being transported while overlapping each other will be denoted as "multi-feed" for simplicity. In the following explanations, to the same or corresponding members or parts in the attached drawings, the same reference sign is given and redundant explanations are omitted. Furthermore, the drawings are not intended to show a relative ratio between the members or parts. Accordingly, specific sizes of the members or parts may be determined by a person skilled in the art referring to the non-limiting exemplary embodiment in the following.

The exemplary embodiment will be explained using a multi-feed judging device in the following order:

1. A configuration of the multi-feed judging device, 2. An operation for judging the multi-feed, 3. A program of a method for judging the multi-feed and a recording medium storing the program, and 4. An example of an image forming apparatus.

(1. Configuration of the Multi-Feed Judging Device)

Figure 1B:
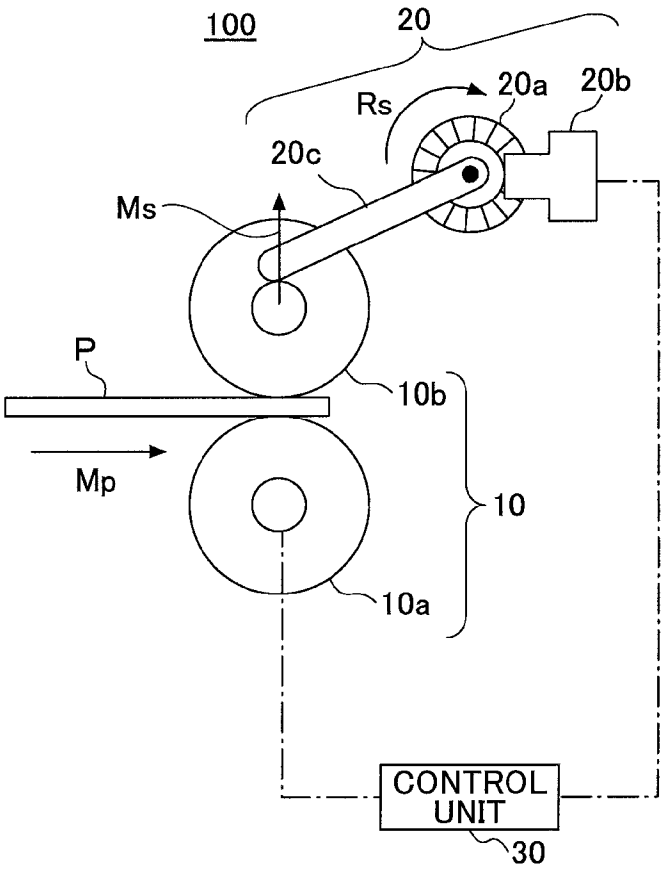
FIGS. 1A to 1C are diagrams schematically illustrating an example of a configuration of a multi-feed judging device according to a present exemplary embodiment.
Figure 1A:
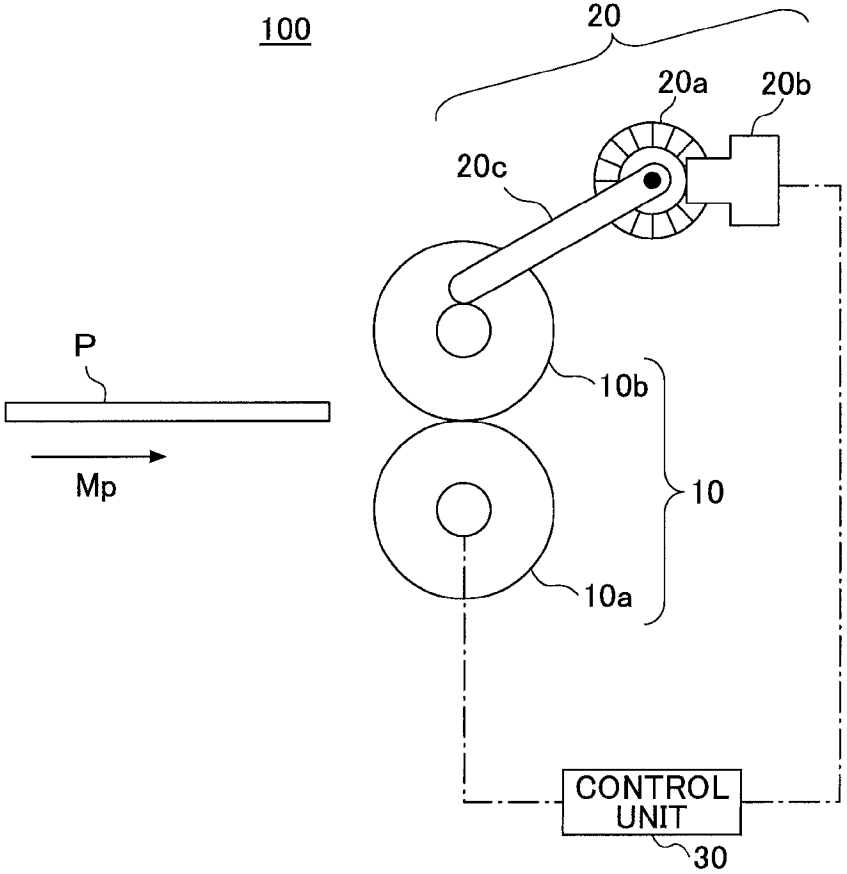
Figure 1C:
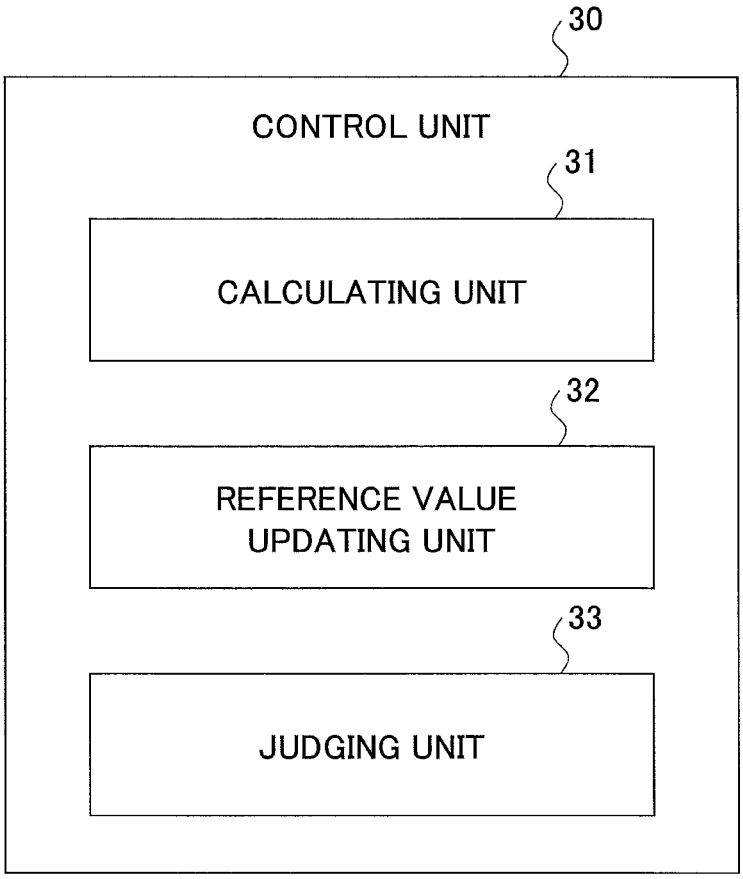
Figure 2A:
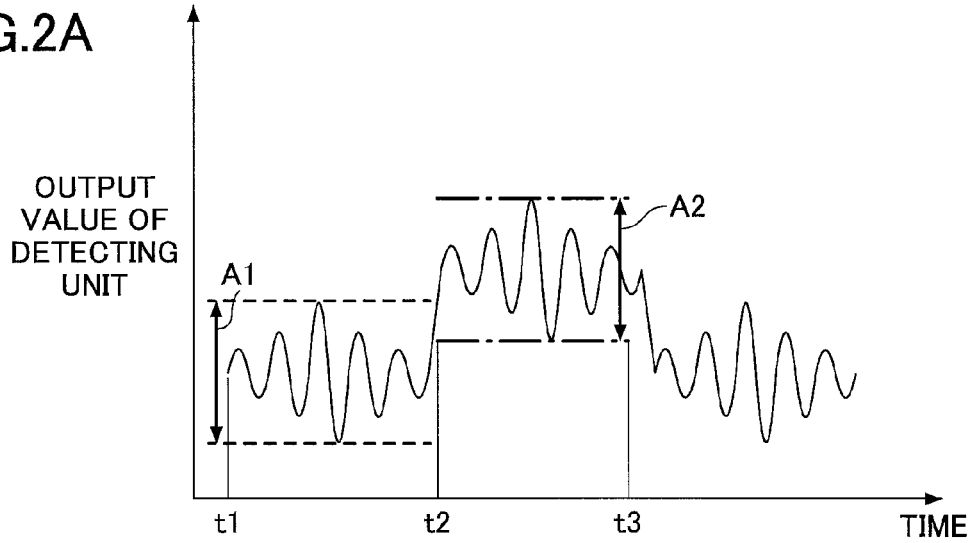
FIGS. 2A to 2C are diagrams illustrating an example of results of detecting by the multi-feed judging device according to the present exemplary embodiment.
Figure 2B:
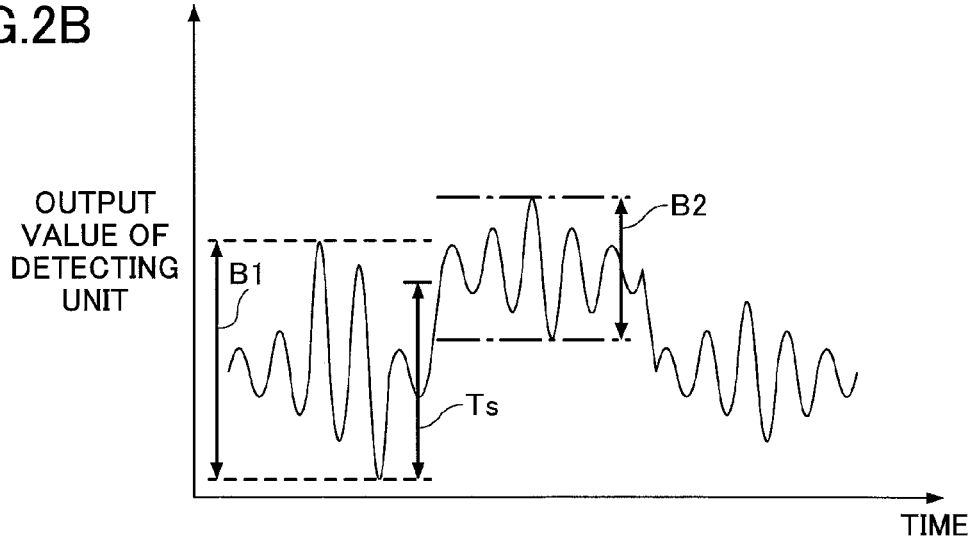
Figure 2C:
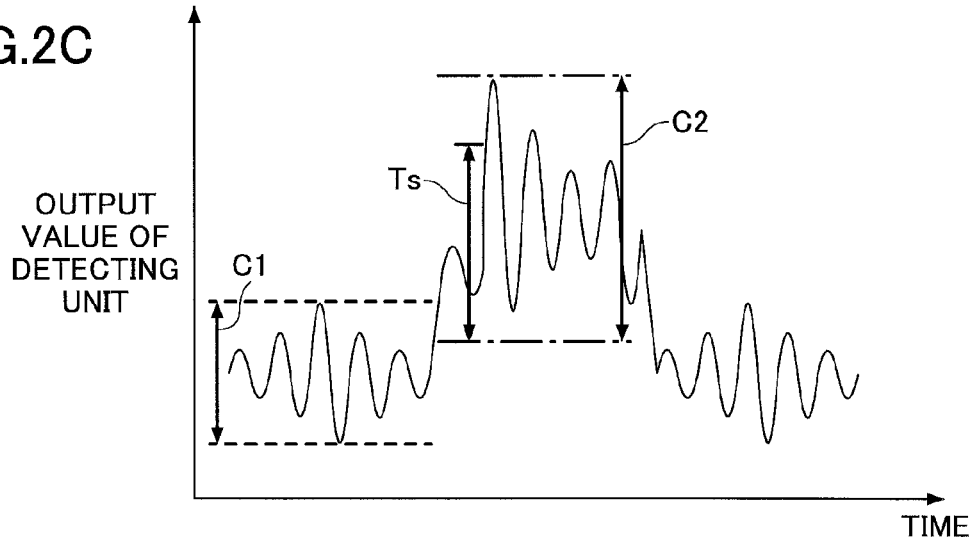
Figure 3:
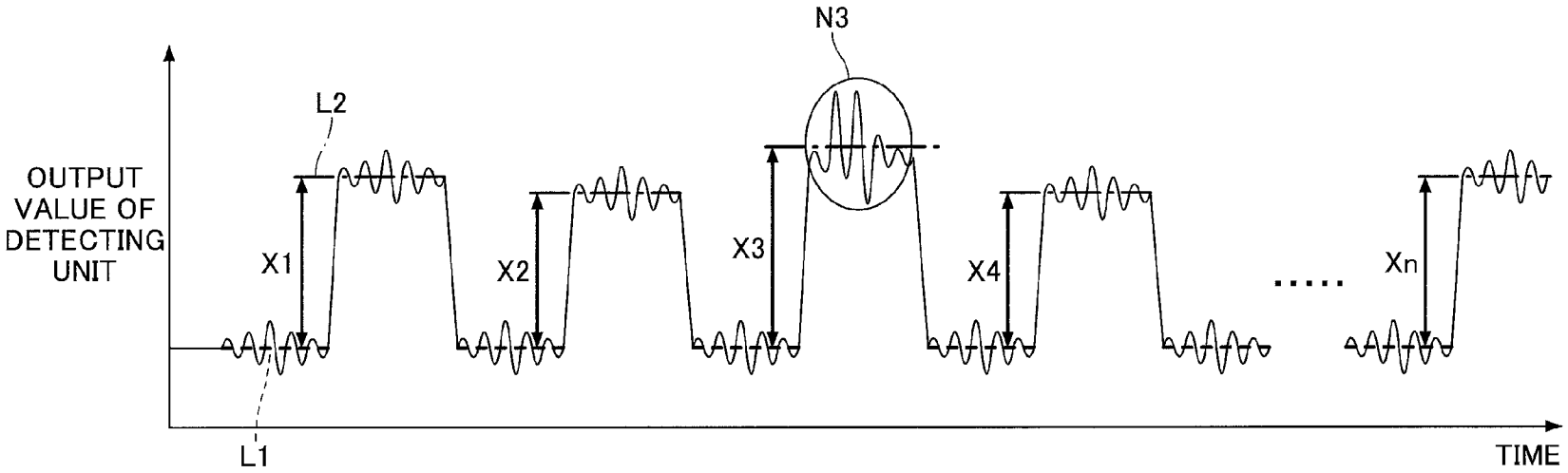
FIG. 3 is a diagram illustrating an example of a result of detecting by the multi-feed judging device for a continuous transporting according to the present exemplary embodiment.

Referring to FIGS. 1A to 5, an example of a configuration of the multi-feed judging device according to the present exemplary embodiment, which will be denoted as a "multi-feed judging device" 100 in the following, will be explained. Moreover, dot-dashed lines in FIGS. 1A and 1B represent a path of an electric control. FIGS. 2A to 2C show an example of a result of detecting a recording medium. In FIGS. 2A to 2C, the detecting the recording medium starts at time t1 on the abscissa. At time t2, a front end of the recording medium is inserted between a pair of rollers, which will be described later. At time t3, a back end of the recording medium passes the pair of rollers. FIG. 3 shows an example of a result of detecting the recording medium in the case of continuously transporting plural recording media.

The multi-feed judging device 100 detects a thickness of the transported recording medium by detecting a position of the recording medium. Moreover, the multi-feed judging device 100 compares the detected thickness of the recording medium and a reference value, and judges whether the transporting of the recording medium is a multi-feed or not.

The multi-feed judging device 100, as shown in FIGS. 1A and 1B, includes a transporting unit 10, a detecting unit 20 and a control unit 30. The transporting unit 10 includes a pair of rollers, i.e. a driving roller 10*a* and a driven roller 10*b*, and transports a recording medium P by using the pair of rollers. The detecting unit 20 detects a position of the driven roller 10*b*. The control unit 30 controls an operation of the multi-feed judging device 100. Moreover, the multi-feed judging device 100 may further include a feeding unit (not shown) which stores a recording medium P before transporting. The multi-feed judging device 100 may include, as the feeding unit, for example, a member which arranges or stores plural recording media, such as a paper feed tray, a manually feeding tray.

The transporting unit 10 transports the recording medium P. In the transporting unit 10, the recording medium P is inserted between the pair of rollers, 10*a* and 10*b*, and is transported by rotations of the pair of rollers. Moreover, the transporting unit 10 according to the present exemplary embodiment may include plural pairs of rollers.

The pair of rollers includes a driving roller 10*a*, which rotates to drive the transporting, and a driven roller 10*b*, which is driven by the driving roller. The transporting unit 10 inserts the recording medium P into a gap between the driving roller 10*a* and the driven roller 10*b*, as shown in FIG. 1B, and rotates the driving roller 10*a* by the driving unit (not shown) and moves (transports) the recording medium P in a transporting direction Mp.

Moreover, the transporting unit 10 according to the present exemplary embodiment, the driven roller 10*b* is provided so that the driven roller 10*b* can move away from the driving roller 10*a*. That is, the driven roller 10*b* is depressed toward the driving roller 10*a* by a pressing unit (not shown). Moreover, the driven roller 10*b* moves, when the recording medium P is inserted into the pair of rollers, away from the driving roller 10*a* in a direction of the arrow Ms, as shown in FIG. 1B.

The detecting unit 20 detects a position of the driven roller 10*b* of the transporting unit 10. The detecting unit 20 detects, as a position of the recording medium P inserted between the driving roller 10*a* and the driven roller 10*b*, the position of the driven roller 10*b*. Moreover, the detecting unit 20 according to the present exemplary embodiment may include plural detecting units corresponding to the number of the pairs of rollers.

The detecting unit 20 according to the present exemplary embodiment includes, as shown in FIGS. 1A and 1B, a wheel 20*a*, on which slits are cut at regular intervals, and a sensor 20*b*, which detects the slits of the wheel 20*a* and provides a rotation angle of the wheel 20*a*. The detecting unit 20 further includes an arm 20*c*, one end of which is fixed to a rotation axis of the wheel 20*a*, and the other end is contacted to the rotation axis of the driven roller 10*b*. According to the above configuration, the detecting unit 20 rotates the wheel 20*a* by using the arm 20*c*, detects a rotational position of the rotated wheel 20*c* by using the sensor 20*b*, and detects the position of the driven roller 10*b*.

Specifically, when the recording medium P is not inserted into the gap in the pair of rollers, the detecting unit 20 detects the position where the driven roller 10*b* is depressed to contact the driving roller 10*a*, as shown in FIG. 1A. The detecting unit 20, as shown in, for example, a time interval from t1 to t2 of FIG. 2A, outputs a value indicating a displacement of the driven roller 10*b* in the departing direction from the driving roller 10*a*. Moreover, the detecting unit 20, for example, as shown in FIG. 1B, when the recording medium P is inserted into the gap in the pair of rollers, detects the position of the driven roller 10*b* which has been moved from the driving roller 10*a* in the departing direction. That is, the detecting unit 20 raises the arm 20*c* in the direction shown by the arrow Ms, according to the displacement of the driven roller 10*b*. The wheel 20*a* rotates in the direction shown by Rs according to the raise of the arm 20*c*. The sensor 20*b* detects the rotational position of the wheel 20*a*. Then, the detecting unit 20, as shown in, for example, a time interval from t2 to t3 of FIG.

2A, outputs a value indicating the displacement of the driven roller 10*b* in the departing direction from the driving roller 10*a*.

Moreover, the detecting unit 20, as shown by N3 in FIG. 3, for example, may detect a displacement including a periodically or unexpectedly arising noise. The noise may arise due to an abrasion of the rollers, an eccentricity of the rotation axis, a vibration of the apparatus, or the like. In this case, the detecting unit 20 (the multi-feed judging device 100) may eliminate from an output value the influence of the noise or the like, and output the value where the influence of noise has been eliminated as the detection result (output value), as shown by lines L1 and L2 in FIG. 3, for example. Furthermore, the detecting unit 20 (the multi-feed judging device 100) may output an average value obtained by averaging sampled values within a predetermined time period.

The detecting unit 20 is not limited to the one in the present exemplary embodiment, as long as the detecting unit can detect the position of the driven roller 10*b*. Furthermore, the detecting unit 20 according to the present exemplary embodiment may include, for example, a photo sensor, a rotary encoder, an encoder sensor, an optical sensor, a magnetic sensor, an electrostatic sensor, a direct acting sensor, or the like.

The control unit 30 issues instructions to respective members of the multi-feed judging device 100 and controls operations of the respective members. FIG. 1C illustrates an example of a configuration of the control unit. The control unit 30 includes a calculating unit 31, a reference value updating unit 32, and a judging unit 33. The calculating unit calculates a thickness of the transported recording medium P, which will be denoted as a "thickness X" in the following. The reference value updating unit 32 updates a reference value of the thickness of the recording medium P, which will be denoted as a "reference value Y" in the following. The judging unit 33 judges whether the recording media overlap each other or not.

The control unit 30 controls the operation of the transporting unit 10, and thus controls the operations for transporting the recording medium P, including moving, importing, discharging, pinching, holding and the like. The control unit 30 controls the operation of the detecting unit 20, and thus controls the operations for detecting the recording medium P.

Moreover, the control unit 30 controls the operation for the calculating unit 31, and thus controls the operation for calculating the thickness of the recording medium P. The control unit 30 controls the operation of the reference value updating unit 32, and thus controls the operation for updating the reference value Y. The control unit 30 controls the operation of the judging unit 33, and thus controls the operation for judging whether the recording media overlap each other or not.

The control unit 30 may include an arithmetic processing unit which includes a central processing unit (CPU) and a memory unit (ROM (read-only memory) and RAM (random access memory)) of a related art. Moreover, the control unit may control the operations of the respective members of the multi-feed judging device 100 by using a program stored in advance, such as a control program and an application program. Furthermore, the control unit 30 may control the respective members of the multi-feed judging device 100 based on information or the like input by an inputting unit (not shown).

The calculating unit 31 calculates the thickness X. The calculating unit 31 calculates the thickness X of the recording medium P, by using the positions of the pair of rollers, i.e. the driven roller 10*b*, when the recording medium is transported, and the position of the pair or rollers when the recording medium is not transported. The multi-feed judging device 100 detects an amount of the displacement of the driven roller 10*b* when the recording medium P is transported, using the detecting unit 20, as shown in FIG. 3, for example. The quantity of the displacement of the position of the driven roller 10*b* changes according to the thickness of the recording medium P pinched by the pair of rollers. The calculating unit 31 calculates as the thickness X of the recording media P, a difference, as shown by X1 in FIG. 3, for example, between the position of the driven roller 10*b* when the recording medium P is transported, as shown by the line L2 in FIG. 3, for example, and the position of the driven roller 10*b* when the recording medium P is not transported, as shown by the line L1 in FIG. 3.

The calculating unit 31 according to the present exemplary embodiment calculates the thickness X, by using a detection value detected by the detecting unit 20, the position of the driven roller 10*b*, when the position detected by the detecting unit 20 is in a predetermined range. That is, when the detection value detected by the detecting unit 20 includes an error, the calculating unit 31 excludes the detection value including the error and calculates the thickness X. The multi-feed judging device 100 estimates previously, for example, a difference (range) between the maximum of the detection value and the minimum of the detection value taking account of the error previously assumed. When the plural thicknesses of the recording media are detected, by using only the detection values included in the range, and the thickness X is calculated. According to the process as above, an accuracy of the calculated thickness X is improved.

Specifically, the calculating unit 31, as shown in FIG. 2B, does not use a detection value for calculating the thickness X, if the difference between the maximum of the detection value output from the detecting unit 20 when the recording medium P is not transported and the minimum thereof, as shown by B1 in FIG. 2B, is greater than a threshold Ts, i.e. out of the predetermined range. Moreover, the calculating unit 31, as shown in FIG. 2C, does not use a detection value for calculating the thickness X, if the difference between the maximum of the detection value output from the detecting unit 20 when the recording medium P is transported and the minimum thereof, as shown by C2 in FIG. 2C, is greater than the threshold Ts. According to the above process, the multi-feed judging device 100 can exclude the detection value which includes the error by using the calculating unit 31, and an accuracy of the reference value Y updated by the reference value updating unit, which will be explained later, is improved. Moreover, an example of the updating operations for updating the reference value Y by the reference value updating unit 32 will be explained in the following section of the operation for judging the multi-feed, and in the Example.

The predetermined range with the threshold Ts may be a range corresponding to a kind or a mounting position of the detecting unit 20 (a sensor, for example), a kind or a material of the transporting unit 10 (a roller, for example), or a specification of the multi-feed judging device 100. Moreover, the predetermined range may be, for example, a range which is changed according to a status of use or a temperature of the multi-feed judging device 100. Furthermore, the predetermined range may be determined by an experiment or by numerical calculations. Furthermore, the predetermined range may be defined by at least two of the above-described ranges.

The reference value updating unit 32 updates the reference value Y for the thickness. The reference value updating unit 32 updates or stores the reference value Y for the recording medium P, using the thickness X calculated by the calculating unit 31. The reference value updating unit 32 according to the present exemplary embodiment updates the reference value Y by using a reference value Y previously updated and a thickness X newly calculated by the calculating unit 31.

The reference value updating unit 32, for example, in the case that plural feeding devices (trays) are provided, may set (update) a reference value for each of the feeding devices. Moreover, the reference value updating unit 32, as the reference value Y, for example, in the case of transporting plural kinds of recording media, may set (update) a reference value for each of the kinds of the recording media. Furthermore, the reference value updating unit 32 may reset the reference value Y, when the feeding device is open or close, power of the multi-feed judging device is off, or in the energy saving mode, or the like. Moreover, an example of the operation for updating the reference value by the reference value updating unit 32 will be described in the following section of the operation for judging the multi-feed, and in example.

2. Operation for Judging Multi-Feed

Referring to FIGS. 3 to 5, an example of an operation for judging, when plural recording media P are transported continuously, whether the plural recording media P overlap each other or not, will be explained.

As shown in FIG. 3, the multi-feed judging device according to the present exemplary embodiment, as a transporting step, starts transporting plural recording media P continuously. Specifically, the multi-feed judging device 100, by using a pair of rollers (transporting unit 10), while inserting the recording media P sequentially into the pair of rollers, rotates the driving roller 10*a*, and transports the recording media P in the transporting direction Mp, as shown in FIGS. 1A and 1B.

Next, the multi-feed judging device 100, as a detecting step, detects a position of the recording medium P pinched by the pair of rollers. Specifically, the multi-feed judging device 100, by using the detecting unit 20, detects a quantity of displacement of the position of the driven roller 10*b* of the pair of rollers pinching the recording medium P. The multi-feed judging device 100 (the detecting unit 20), as shown in FIG. 3, for example, sequentially detects, as an output value of the detecting unit 20, the displacement of the driven roller 10*b* when the recording media P transported continuously are inserted sequentially into the pair of rollers.

Next, the multi-feed judging device 100, as a calculating step, calculates a thickness X of the transported recording medium P, based on the position of the driven roller 10*b* detected in the detecting step when the recording medium is transported and the position of the driven roller 10*b* when the recording medium is not transported. Specifically, the multi-feed judging device 100, when the position of the driven roller 10*b* detected for each of the recording media in the detecting step is within the predetermined range with the threshold Ts, uses the calculating unit 31, calculates sequentially a difference between the position of the driven roller when the recording medium is transported and the position of the driven roller when the recording medium is not transported, and thus obtains the thickness X from the calculated difference.

The multi-feed judging device 100, then, as a reference value updating step, by using the thickness X calculated in the calculating step, updates the reference value Y for the recording medium P.

Specifically, the reference value updating unit 32, as shown in FIG. 4B, when the second sheet of the recording media is judged whether the recording media overlap each other, referring to a reference value Y1, to which the reference value updating unit 32 sets the thickness X1, previously calculated by the calculating unit 31. Moreover, the reference value updating unit 32, when the third sheet of the recording media is judged whether the recording media overlap each other referring to Y2, to which the reference value updating unit 32 sets an average of the previous reference value Y1 and the thickness X2, newly calculated by the calculating unit 31. That is, the reference value updating unit 32, as shown in FIG. 4A and a formula shown below, sets an average of the reference value Y(n−1), updated previously, and the thickness X(n), newly calculated by the calculating unit 31, to the new reference value Y(n). The reference value Y(n) is referred when the (n+1)-th sheet of the recording media is judged whether the recording media overlap each other. The above process is expressed by the following formula:

$$Y(n)=(Y(n-1)+X(n))/2. \quad \text{(Formula 1)}$$

Moreover, the reference value updating unit 32, for example, in the case that the detection value for the third sheet of the recording media includes an error, as shown by N3 of FIG. 3, updates the reference value Y2 by not including the thickness of the third sheet X3, as shown in FIG. 4B, i.e. the reference value Y2 is set to the reference value Y3. The reference value Y3 is referred when the fourth sheet of the recording media is judged whether the recording media are overlapping each other. That is, the reference value updating unit 32 excludes a detection value having an error, and updates sequentially the reference value Y.

Furthermore, the reference value updating unit 32, may set an average of plural thicknesses calculated by the calculating unit 31, as shown by X1, X2, X3 and X4 of FIG. 4A to a new reference value, as shown by Y4 of FIG. 4A, for example. The average may be a simple average, or may be a weighted average. The reference value updating unit 32 may exclude a detection value having an error from the plural thicknesses calculated by the calculating unit 31, and obtain an average of the thicknesses.

Next, the multi-feed judging device 100, as a judging step, by using the reference value Y updated in the reference value updating step, judges the next sheet of the recording media whether the recording media overlap each other.

Specifically, the judging unit 33, as shown in FIG. 5, when the n-th sheet of the recording media is judged whether the recording media overlap each other, compares the reference value Y(n−1), updated previously, with the thickness X(n), newly calculated by the calculating unit 31, and judges whether the recording media overlap each other or not. The judging unit 33, when a difference between the reference value Y(n−1) and the thickness X(n) is, for example, out of a predetermined range with a threshold Tp, i.e. the difference is greater than a predetermined threshold Tp, judges that recording media overlap each other. According to the above process, the judging unit 33, for plural recording media P transported continuously, when two or more of the recording media overlap each other, can judge for each sheet of the recording media whether recording media overlap each other.

The predetermined threshold Tp according to the present exemplary embodiment may be a value corresponding to a kind of the transported recording medium, a kind or a mounting position of the detecting unit 20 (a sensor, for example), a kind or a material of the transporting unit 10 (a roller, for example), or a specification of the multi-feed judging device 100. Moreover, the predetermined threshold Tp may be a value, which is changed according to the temperature of the recording medium. Furthermore, the predetermined threshold Tp may be determined by an experiment or by numerical calculations. Moreover, the judging unit 33 may further using information input to the multi-feed judging device 100, such as information on the kind of the recording medium or the like and information on the threshold, judge whether the recording media overlap each other.

3. Program and Recording Media Storing the Program

According to an aspect of the present exemplary embodiment, a program executes a multi-feed judging method. The multi-feed judging method includes: a step of holding a recording medium between a driving roller and a driven roller, which is driven by the driving roller, and transporting the recording medium by rotating the driving roller; a step of detecting a position of the driven roller when the recording medium is transported, and a position of the driven roller when the recording medium is not transported; a step of calculating a thickness of the recording medium based on a position of the driven roller when the recording medium is transported and a position of the driven roller when the recording medium is not transported; a step of updating a reference value for the thickness by using the thickness calculated in the step of calculating the thickness; a step of judging, using the reference value updated in the step of updating the reference value, whether recording media, which are transported after the reference value was updated, are transported while overlapping each other or not, wherein in the step of calculating the thickness the thickness is calculated by using the position detected in the step of detecting the position, when the position detected in the step of detecting the position is within a predetermined range. Moreover, according to another aspect of the present exemplary embodiment, in the program, the step of calculating the thickness further comprises, in the case that the plurality of recording media are intermittently transported in the step of transporting the recording medium, when positions detected in series in the step of detecting the position are in the predetermined range, a step of calculating the thickness by using the positions detected in series in the step of detecting the position, and the step of updating the reference value further includes a step of updating in series the reference value by using the reference value previously updated and the thickness calculated in the step of calculating the thickness. According to the above configuration, the same effect as the multi-feed judging device 100 can be obtained.

Moreover, the program may be provided in an installable form or in an executable form stored in a recording medium readable by a computer, such as a FD (flexible disk), a CD-ROM (Compact Disk-ROM), a CD-R (CD recordable), a DVD (Digital Versatile Disk), and other computer readable media. Furthermore, a flush memory, a semiconductor memory, such as a RAM (random access memory), and a ROM (read-only memory), a memory card, a HDD (Hard Disk Drive), and other computer readable device may be used. Furthermore, the program may be downloaded via a network and installed. The network is a communication line, such as the internet, a LAN (Local Area Network), or a WAN (Wide Area Network).

According to the present exemplary embodiment, the multi-feed judging device 100, in the case of transporting plural recording media, even when a detected value of the position of the recording medium includes an error, such as a noise, can judge whether the recording media overlap each other or not. Moreover, according to the present exemplary embodiment, the multi-feed judging device 100, even when a detection value detected by the detecting unit 20 includes an error, excludes the detection value including the error, and can calculate a thickness X of the recording medium. Furthermore, according to the present exemplary embodiment, since the multi-feed judging device 100, excludes the detection value including the error and calculates the thickness X of the recording medium, accuracy of a reference value Y updated for each of the recording media is improved. That is, the multi-feed judging device 100, even when the detection for the recording medium includes an error, excludes the detection value including the error, calculates the thickness X, updates the reference value Y using the thickness X, and thus accurately judges whether the transporting recording media overlap each other or not without being affected by the error.

Example

An example of an image forming apparatus 100E including the multi-feed judging device 100 according to the present exemplary embodiment will be described. The image forming apparatus 100E, in the Example, is an electrophotographic apparatus. Moreover, in the image forming apparatus a paper is employed for the recording medium P and a detecting sensor is employed for the detecting unit 20.

Moreover, the image forming apparatus according to the Example is not limited to the eletrophotographic apparatus. That is, the image forming apparatus may employ other image forming methods, such as an ink-jet printing method.

(Configuration of the Image Forming Apparatus)

Figure 6:
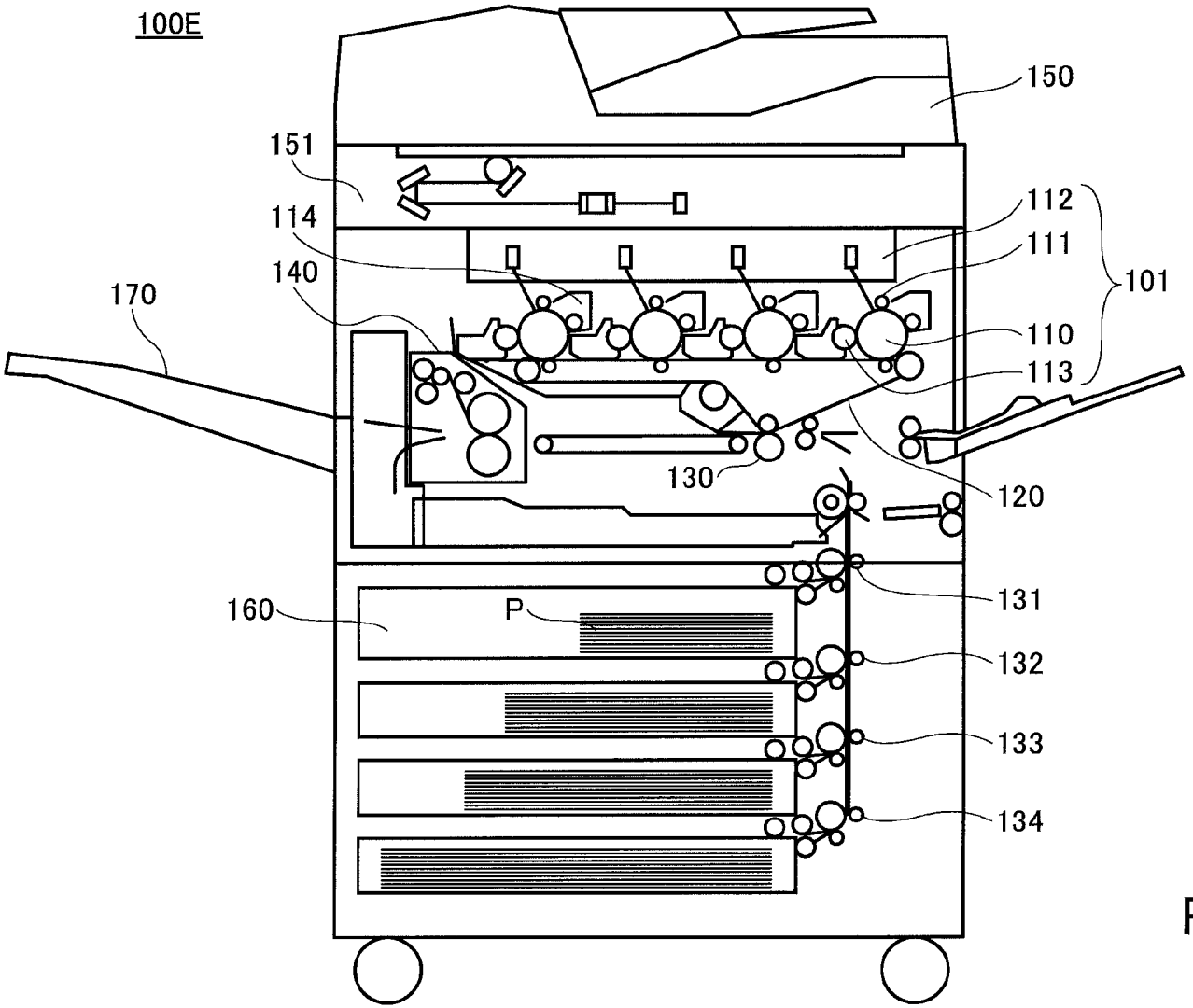
FIG. 6 is a diagram schematically illustrating an example of a configuration of an image forming apparatus according to the present exemplary embodiment.

Referring to FIG. 6, a configuration of the image forming apparatus 100E according to the Example will be described. Moreover, since the configuration of the image forming apparatus 100E includes a configuration of the multi-feed judging device 100 according to the present exemplary embodiment, a different part will be mainly explained.

The image forming apparatus 100E according to the Example, as shown in FIG. 6, includes an image forming unit 101, an intermediate transfer belt 120, a secondly transfer roller 130, a fixing device 140 and a cleaning device 114. The image forming unit 101 includes plural photoreceptors 110 corresponding to respective colors, a charging device 111, an exposing device 112 and a developing device 113. The image forming apparatus 100E further includes a feeding unit 160 for accommodating and feeding a paper on which an image is formed, a reading unit 151 for reading out an image (image data) drawn (formed) on a document, and an automatic document feeder (ADF) 150 for transporting the manuscript.

The image forming apparatus 100E according to the Example includes, as the image forming unit 101, plural developing units including the photoreceptors 110 which form toner images in different colors. The image forming unit 101 forms a color image on the recording medium accommodated in the feeding unit 160.

The charging device 111 uniformly charges a surface of the rotating photoreceptor 110. The exposing device 112 exposes the surface of the photoreceptor 110, based on, for example, an image data read out by the reading unit 151 from the document placed on the ADF 150, and generates an electrostatic latent image. The developing device 113 develops the electrostatic latent image formed on the surface of the photoreceptor 110 by using developer, and forms a toner image.

On the intermediate transfer belt 120, the toner images on the rotating photoreceptors 110 are transferred overlapping each other, after the toner images with different colors are formed on the photoreceptor by the plural developing units in the image forming unit 101. In the secondary transferring part between the intermediate transfer belt 120 and the secondary transfer roller 130, the toner image transferred onto the intermediate transfer belt 120 is secondarily transferred onto the paper transported by the plurality of rollers, 131-134, from the feeding unit 160.

The fixing device 140 heats and pressurizes the paper on which the toner image has been transferred. The heated and pressurized toner image is fixed on the paper.

The cleaning device 114 cleans the surface of the photoreceptor 110 after the toner image was transferred to the intermediate transfer belt 120. The image forming apparatus 100E prepares the next image to be formed by removing toner, which remains after the transferring, on the surface of the photoreceptor 110 using the cleaning device 114.

The feeding unit 160 accommodates and feeds a paper on which an image is formed. The feeding unit 160 in the Example includes plural feeding trays.

The image forming apparatus 100E according to the Example can include the multi-feed judging device 100 according to the present exemplary embodiment for the plurality of rollers, 131 or the like, in the feeding unit 160. The image forming apparatus 100E according to the Example detects a thickness of a paper on which an image is formed by using the multi-feeding judging device 100. Moreover, the image forming apparatus 100E according to the Example configures settings for conditions, for example, for the secondary transferring, for the fixing or the like, according to the thickness detected by the multi-feed judging device. The image forming apparatus according to the Example can form an image on a paper in the condition that appropriately corresponds to the thickness of the paper.

Furthermore, the image forming apparatus according to the Example judges whether the transported recording media overlap each other or not based on the thickness of the recording medium detected by using the multi-feed judging device 100. Moreover, the image forming apparatus 100E according to the Example, when the multi-feed judging device judges that the transported recording media overlap each other, outputs information of the multi-feed using an outputting unit (not shown), such as aborting an image forming operation or the like.

The image forming apparatus 100E according to the Example further includes an engine control unit including the calculating unit 31, the reference value updating unit 32 and the judging unit 33 of the control unit 30. The engine control unit controls the operation of the calculating unit 31, the reference value updating unit 32 and the judging unit 33. Moreover, the engine control unit configures arbitrarily settings for a process condition, such as a timing of feeding from the feeding unit 40, a fixing temperature at the fixing unit 60, a condition for generating a toner image in the image forming unit 50, or the like, according to at least one of image data to be formed and a thickness of the paper calculated by the calculating unit 31.

Moreover, the control unit 30 (the engine control unit 30E) may include a CPU (Central Processing Unit), ROM (Read-only Memory), and RAM (Random Access Memory), or the like. The CPU reads an Operation System or a program from a storing unit and executes it, and then provides a variety of functions. Moreover, the CPU executes logical operations using a controlling program or the like stored in the ROM, and then controls the respective units, and calculates and processes data. The ROM stores the controlling program and information on operating conditions or the like. The RAM is a work memory (cache memory), which temporarily holds necessary data in executing a program. RAM is used as a work area in the case that the CPU executes logical operations.

(Operation for Judging Multi-Feed on Forming Images in the Image Forming Apparatus)

Figure 8A:
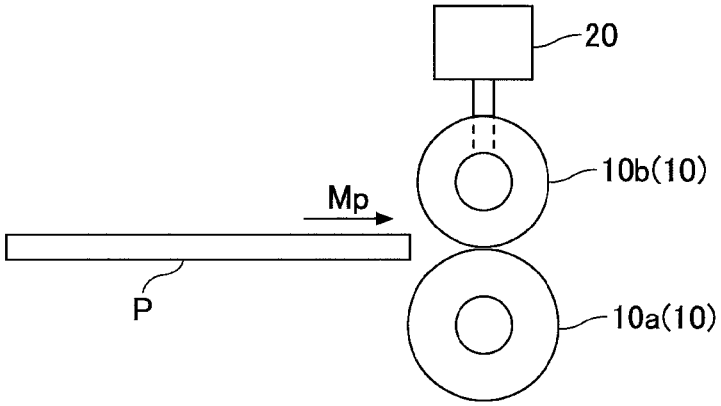
FIGS. 8A to 8C are diagrams explaining an example of an operation of a transporting unit of the multi-feed judging device according to the present exemplary embodiment.
Figure 8B:
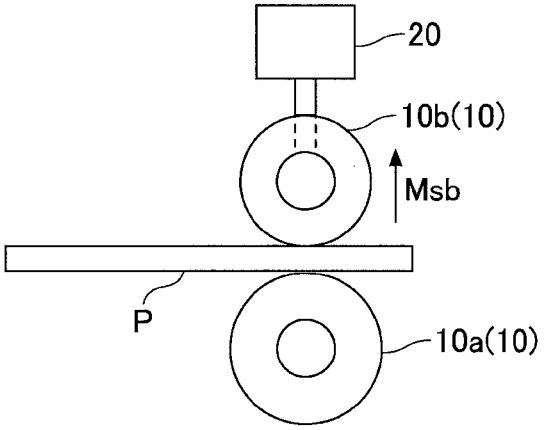
Figure 8C:
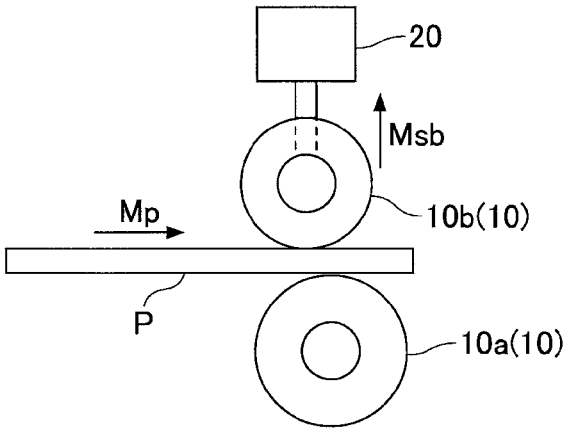
Figure 9:
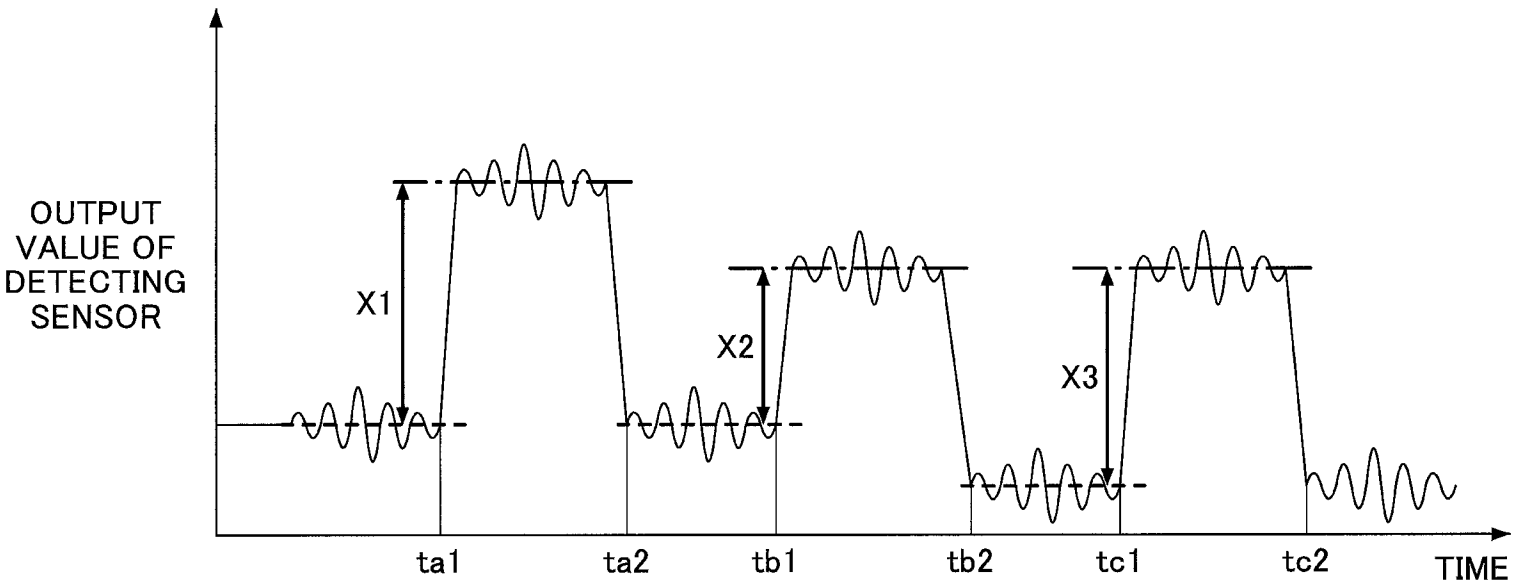
FIG. 9 is a diagram illustrating an example of a result of detecting by the image forming apparatus for the continuous transporting according to the present exemplary embodiment.

Referring to FIGS. 7 to 9, an example of an operation when the image forming apparatus according to the Example judges a multi-feed for transported paper on forming an image will be described in the following.

The image forming apparatus 100E according to the Example, on forming an image, at first, as a transporting step, transports respective plural papers continuously or intermittently from the feeding unit 160 in FIG. 6. The image forming apparatus 100E (the multi-feed judging device 100), then, as a detecting step, detects a position of the paper transported in series. Specifically, a position of the driven roller of the pair of rollers, 131 is detected in series when the paper is inserted (on transporting) and when the paper is not inserted (on not transporting).

Next, the image forming apparatus 100E, as a calculating step, based on a difference between the position of the driven roller when the paper is inserted and the position when the paper is not inserted which was detected in the detecting step, calculates a thickness X of the transported paper. Specifically, for example, the image forming apparatus 100E, detects a thickness X1 of the first paper as 70, a thickness X2 of the second paper as 80, a thickness X3 of the third paper as 110 and a thickness X4 of the fourth paper as 145, using the calculating unit 31, as shown in a column of detected thickness X(n) in FIG. 7A.

Next, the image forming apparatus 100E, as a reference value updating step, using the thickness X calculated in the calculating step, updates a reference value Y, which is set for each of the papers. Specifically, the image forming apparatus 100E, using the reference value updating unit 32, sets the thickness of the first paper X1 to a reference value Y1 for the second paper. Moreover, an average of the thickness of the second paper X2 and the reference value Y1 for the second paper, 75, is set to a reference value Y2 for the third paper. Furthermore, the image forming apparatus sets the reference value Y2 for the third paper to a reference value Y3 for the fourth paper, since the thickness of the third paper X3 is out of the predetermined range with the threshold Is (greater than or equal to 60 and less than 100, for example). That is, the image forming apparatus 100E judges that the detection value for the thickness of the third paper X3 includes an error, since the detection value of the thickness X3 is 110 and is out of the range with the threshold Ts. The reference value Y2 is updated to the reference value Y3 by not including the thickness of the third paper X3, i.e. the reference value Y2 is set to the reference value Y3 for the fourth paper, so as to exclude the detection value including the error.

Furthermore, the image forming apparatus 100E, as the judging step, judges a multi-feed, using the reference value Y updated for each of the papers in the reference value updating step. Specifically, the image forming apparatus 100E, using the judging unit 33, compares the thickness X2 of the second paper with the reference value Y1, and judges that a multi-feed does not occur, i.e. a ratio of the thickness X2 to the reference value Y1 is 1.14, which is in the predetermined range with the threshold Tp (greater than or equal to 0.8 and less than 1.7, for example), as shown in the column of ratio (X(n)/Y(n−1)) in FIG. 7B. Moreover, the image forming apparatus 100E compares the thickness X3 of the third paper with the reference value Y2, and judges that a multi-feed does not occur, i.e. a ratio of the thickness X3 to the reference value Y2 is 1.47, which is in the predetermined range with the threshold Tp (greater than or equal to 0.8 and less than 1.7, for example). Furthermore, the image forming apparatus 100E compares the thickness X4 of the fourth paper with the reference value Y3, and judges that a multi-feed occurs, i.e. a ratio of the fourth paper with the reference value Y3 is 1.93, which is out of the range with the threshold Tp (greater than or equal to 0.8 and less than 1.7, for example). That is, the image forming apparatus 100E judges that the transporting papers overlap each other referring to the reference value Y3. The reference value was updated by not incorporating the thickness of the third paper X3, since the detection value is judged to include an error, in the reference value updating step.

The image forming apparatus 100E, then, in the case when the multi-feed is judged to occur, judges whether to finish the operation for forming an image on a paper or not. The image forming apparatus 100E may output information on the multi-feed using the outputting device, and then based on information input by a user or the like the image forming apparatus may judge whether to finish the operation for forming the image on the paper.

As described above, for the image forming apparatus 100E the same effect is obtained as for the multi-feed judging device 100. Moreover, the image forming apparatus, according to the Example, can temporarily halt the operation for forming an image, in the case that the multi-feed is judged to occur for the transporting paper (recording media).

On the other hand, in a comparative example, as shown in FIG. 7B, using the thickness X3 for the third paper, the detection value of which is judged to include an error in the reference value updating step, the reference value Y3 for the fourth paper is updated (calculated) including the thickness of the third paper, as for the other reference values. In this case, in the comparative example of FIG. 7B, the image forming apparatus compares the thickness X4 for the fourth paper with the reference value Y3, and the image forming apparatus judges that a multi-feed does not occur, i.e. the ratio of X4 to Y3 is 1.57, which is in the predetermined range (greater than or equal to 0.8 and less than 1.7). That is, in the case of the result in the comparative example as shown in FIG. 7B, the image forming apparatus may erroneously judge that the multi-feed does not occur, in the case that the multi-feed occurs.

Referring to FIG. 8, an error included in the detection value output from the detection unit 20 will be explained in the following.

As shown in FIG. 8A, the detecting unit 20 moves a recording medium P (a paper, for example) in the direction of a transporting direction Mp, and inserts the recording medium P into gap in the pair of rollers. In this case, as shown in FIG. 8B, when the recording medium P is inserted between the driving roller 10*a* and the driven roller 10*b*, the driven roller moves in the separating direction Msb by a distance, which is the same as the thickness of the recording medium P.

On the other hand, as shown in FIG. 8C, in the detecting unit 20, when the recording medium P is inserted between the driving roller 10*a* and the driven roller 10*b*, the rotational axis of the driving roller or the driven roller may move in the transporting direction Mp. The driven roller 10*b*, then moves in the separating direction Msb. The distance, the driven roller 10*b* moves, may be different from the thickness of the recording medium P. Accordingly, the detection value output from the detecting unit 20 includes an error which does not correspond to the thickness of the recording medium P.

Referring to FIG. 9, another example of the error included in the detection value (output value) output from the detecting unit 20 will be explained in the following.

While the image forming apparatus continuously transports the recording media P (papers, for example), a disturbance may enter the image forming apparatus, and the output value from the detecting unit 20 may be shifted by a certain value. Specifically, as shown in FIG. 9, after the image forming apparatus 100E transports the first recording medium P (from ta1 at to ta2, in FIG. 9), a disturbance enters and the output values of the detecting unit 20, when the second recording medium P is transported (from tb1 to tb2), are shifted. In this case, the image forming apparatus detects (calculates) the thickness X2 of the second recording medium P significantly less than the thickness X1 of the first recording medium P. Moreover, the disturbance may be, for example, a mechanical displacement of the contact point between the pair of rollers, a switching in the detecting unit, occurrence of failure in the detecting unit, a mechanical or electrical external force applied to the image forming apparatus, or the like.

Further, the present invention is not limited to these embodiments, but various variations and modifications may be made without departing from the scope of the present invention.

The present application is based on Japanese priority application No. 2012-281306 filed on Dec. 25, 2012, with the Japanese Patent Office, the entire contents of which are hereby incorporated by reference.

What is claimed is:

1. A multi-feed judging device comprising:

a transporting unit that holds a recording medium between a driving roller and a driven roller, which is driven by the driving roller, and transports the recording medium by rotating the driving roller;

a detecting unit that detects a position of the driven roller;

a calculating unit that calculates a thickness of the recording medium based on a position of the driven roller when the recording medium is transported and a position of the driven roller when the recording medium is not transported;

a reference value updating unit that updates a reference value of the thickness by using the calculated thickness; and a judging unit that judges, using the reference value updated by the reference value updating unit, whether recording media, which are transported after the reference value was updated, are transported while overlapping each other or not, wherein:

the calculating unit calculates the thickness by using the position detected by the detecting unit, when the position detected by the detecting unit is within a set range, and the reference value updating unit updates a reference value for each kind of recording media, and resets the reference value when at least one of opening or closing a feeding device, powering off the multi-feed judging device, and switching to an energy saving mode.

2. The multi-feed judging device as claimed in claim 1, wherein the reference value updating unit, by using the reference value previously updated and the thickness calculated by the calculating unit, updates the reference value.

3. The multi-feed judging device as claimed in claim 2, wherein the reference value updating unit sets, to the updated reference value, an average of the previously updated reference value and the thickness calculated by the calculating unit, or an average of a plurality of thicknesses calculated by the calculating unit.

4. The multi-feed judging device as claimed in claim 1, wherein the reference value updating unit updates the reference value, when the position detected by the detecting unit is out of the set range, by setting the previously updated reference value to the updated reference value.

5. The multi-feed judging device as claimed in claim 1, wherein the set range is defined as at least one of a range corresponding to a kind or a mounting position of the detecting unit, a range corresponding to a kind or a material of the transporting unit, and a range which is changed according to a status of use or a temperature.

6. The multi-feed judging device as claimed in claim 1, wherein the judging unit judges that the recording media overlap each other when a difference between the reference value updated by the reference value updating unit and a thickness of the recording media, which is transported after the reference value was updated, calculated by the calculating unit, is greater than a set threshold.

7. An image forming apparatus comprising the multi-feed judging device as claimed in claim 1, and an image forming unit that forms an image on the transported recording medium.

8. The multi-feed judging device as claimed in claim 1, wherein when the position detected by the detecting unit includes an error, the calculating unit excludes the position including the error and calculates the thickness.

9. The multi-feed judging device as claimed in claim 1, wherein the calculating unit estimates previously a difference between a maximum of a detection value and a minimum of a detection value while taking account of an error previously assumed.

10. The multi-feed judging device as claimed in claim 9, wherein the calculating unit does not use the detection value for calculating the thickness if the difference between the maximum of the detection value output from the detecting unit when the recording medium is not transported and the minimum thereof is greater than a predetermined threshold.

11. The multi-feed judging device as claimed in claim 9, wherein the calculating unit does not use the detection value for calculating the thickness if the difference between the maximum of the detection value output from the detecting unit when the recording medium is transported and the minimum thereof is greater than a predetermined threshold.

12. The multi-feed judging device as claimed in claim 1, wherein the detecting unit includes:

a wheel, on which slits are cut at regular intervals; and a sensor which detects the slits of the wheel.

13. The multi-feed judging device as claimed in claim 12, further comprising an arm, one end of which is fixed to a rotational axis of the wheel, and the other end is contacted to the rotation axis of the driven roller.

14. A multi-feed judging method comprising:

a transporting step for holding a recording medium between a driving roller and a driven roller, which is driven by the driving roller, and for transporting the recording medium by rotating the driving roller;

a detecting step for detecting a position of the driven roller when the recording medium is transported, and a position of the driven roller when the recording medium is not transported;

a calculating step for calculating a thickness of the recording medium based on a position of the driven roller when the recording medium is transported and a position of the driven roller when the recording medium is not transported;

a reference value updating step for updating a reference value for the thickness by using the thickness calculated in the calculating step; and a judging step for judging, using the reference value updated in the reference value updating step, whether recording media, which are transported after the reference value was updated, are transported while overlapping each other or not, wherein:

in the calculating step, the thickness is calculated by using the position detected in the detecting step, when the position detected in the detecting step is within a set range, and in the reference value updating step, a reference value is updated for each kind of recording media, and is reset when at least one of opening or closing a feeding device, powering off the multi-feed judging device, and switching to an energy saving mode.

15. The multi-feed judging method as claimed in claim 14, wherein the calculating step further comprises, in the case that the plurality of recording media are intermittently transported in the transporting step, when positions detected in series in the detecting step are in the set range, calculating the thickness by using the positions detected in series in the detecting step, and the reference value updating step further comprises updating in series the reference value by using the reference value previously updated and the thickness calculated in the calculating step.

16. A non-transitory computer-readable storage medium storing a program for causing a computer to perform a process of judging a multi-feed, the process comprising:

a step of holding a recording medium between a driving roller and a driven roller, which is driven by the driving roller, and transporting the recording medium by rotating the driving roller;

a step of detecting a position of the driven roller when the recording medium is transported, and a position of the driven roller when the recording medium is not transported;

a step of calculating a thickness of the recording medium based on a position of the driven roller when the recording medium is transported and a position of the driven roller when the recording medium is not transported;

a step of updating a reference value for the thickness by using the thickness calculated in the step of calculating the thickness; and a step of judging, using the reference value updated in the step of updating the reference value, whether recording media, which are transported after the reference value was updated, are transported while overlapping each other or not, wherein:

in the step of calculating the thickness, the thickness is calculated by using the position detected in the step of detecting the position, when the position detected is within a set range, and in the reference value updating step, a reference value is updated for each kind of recording media, and is reset when at least one of opening or closing a feeding device, powering off the multi-feed judging device, and switching to an energy saving mode.

17. The non-transitory computer-readable storage medium as claimed in claim 16, wherein the step of calculating the thickness further comprises, in the case that the plurality of recording media are intermittently transported in the step of transporting the recording medium, when positions detected in series in the step of detecting the position are in the set range, a step of calculating the thickness by using the positions detected in series in the step of detecting the position, and the step of updating the reference value further comprises a step of updating in series the reference value by using the reference value previously updated and the thickness calculated in the step of calculating the thickness.

* * * * *